US012114717B2

(12) United States Patent
Davidson-Busch

(10) Patent No.: US 12,114,717 B2
(45) Date of Patent: Oct. 15, 2024

(54) INFANT SOOTHING MITT DEVICE

(71) Applicant: Donielle Davidson-Busch, Kingston, PA (US)

(72) Inventor: Donielle Davidson-Busch, Kingston, PA (US)

( * ) Notice: Subject to any disclaimer, the term of this patent is extended or adjusted under 35 U.S.C. 154(b) by 206 days.

(21) Appl. No.: 17/879,238

(22) Filed: Aug. 2, 2022

(65) Prior Publication Data

US 2023/0126721 A1 Apr. 27, 2023

Related U.S. Application Data

(60) Provisional application No. 63/272,268, filed on Oct. 27, 2021.

(51) Int. Cl.
*A41D 19/00* (2006.01)
*A41D 19/01* (2006.01)
*A41D 19/015* (2006.01)

(52) U.S. Cl.
CPC ..... *A41D 19/0024* (2013.01); *A41D 19/01* (2013.01); *A41D 19/01535* (2013.01)

(58) Field of Classification Search
CPC ..... A41D 19/0024; A41D 19/01; A41D 19/01535; A41D 19/01594; A41D 19/00; A41D 19/0003; A41D 19/0006; A41D 19/001; A61H 23/02; A61H 2201/10; A61H 2201/0153; A61H 2201/0207; A61H 2201/0228; A61F 2007/0087; A61F 2007/0078; A61F 2007/008
(Continued)

(56) References Cited

U.S. PATENT DOCUMENTS 4,979,502 A * 12/1990 Hunt ..... A61H 23/02 601/79
5,520,616 A * 5/1996 Hofmeister ..... A61H 23/0263 601/80

(Continued)

FOREIGN PATENT DOCUMENTS

CN 106389097 A * 2/2017
CN 109044739 A * 12/2018
CN 109172327 A * 1/2019 ..... A41D 19/00

OTHER PUBLICATIONS

English translation of CN 109044739 (Liang) Doc pub. Dec. 21, 2018 (Year: 2018).*

(Continued)

*Primary Examiner* — Amy Vanatta
(74) *Attorney, Agent, or Firm* — Brennan, Manna & Diamond, LLC

(57) ABSTRACT

The present invention discloses an infant soothing mitt device primarily comprised of a heating element that warms the entire device and a vibrating disc that produces soothing vibrations. A gel lining is fitted between the exterior and interior surface to amplify and reverberate the vibrations throughout the device. A control module is preferably fitted to the wrist area of the body and is used to control the differing functions of the device, such as the speaker, the heating element and the vibrating disc. The control module also features a battery, which powers the device and the speaker. In this manner, the device can be utilized to keep an infant warm, mimic the rhythmic motion of a caregiver and calm the infant through melodic sounds.

15 Claims, 6 Drawing Sheets

(58) Field of Classification Search
USPC ..... 2/158
See application file for complete search history.

(56) References Cited

U.S. PATENT DOCUMENTS

| | | | | |
|---|---|---|---|---|
| 5,902,256 | A * | 5/1999 | Benaron | A61H 23/0263 601/60 |
| 7,182,739 | B2 * | 2/2007 | Kopanic | A61H 23/0263 601/57 |
| 7,346,949 | B2 * | 3/2008 | Kamrin-Balfour | A47D 15/003 5/904 |
| 2004/0087881 | A1 * | 5/2004 | Gross | A61H 7/001 601/72 |
| 2006/0041207 | A1 * | 2/2006 | Gross | A61H 23/02 601/72 |
| 2012/0136288 | A1 * | 5/2012 | Napier | A41D 19/0024 601/48 |
| 2013/0041435 | A1 * | 2/2013 | Macsovits | A61F 7/02 607/96 |
| 2013/0296636 | A1 * | 11/2013 | Hubble | A61M 21/02 600/28 |
| 2016/0327979 | A1 * | 11/2016 | Lettow | H05B 3/145 |
| 2020/0261308 | A1 * | 8/2020 | Zhou | A61H 23/02 |
| 2022/0226189 | A1 * | 7/2022 | Sanders | A61H 15/02 |

OTHER PUBLICATIONS

English translation of CN 109172327 (Yang); Doc pub. Jan. 11, 2019. (Year: 2019).*

* cited by examiner

INFANT SOOTHING MITT DEVICE

CROSS-REFERENCE TO RELATED APPLICATION

The present application claims priority to, and the benefit of, U.S. Provisional Application No. 63/272,268 which was filed on Oct. 27, 2021 and is incorporated herein by reference in its entirety.

FIELD OF THE INVENTION

The present invention relates generally to the field of infant soothing devices. More specifically, the present invention is comprised of an infant soothing mitt device in the shape of a hand with a thumb area and a finger area. The device features a heating element that warms the entire device and a vibrating disc that produces soothing vibrations. A gel lining is fitted between the exterior and interior surface to amplify and reverberate the vibrations throughout the device. In this manner, the infant soothing device can be utilized to keep the infant warm, mimic the rhythmic motion of a caregiver and calm the infant through melodic sounds. Accordingly, the present disclosure makes specific reference thereto. Nonetheless, it is to be appreciated that aspects of the present invention are also equally applicable to other like applications, devices and methods of manufacture.

BACKGROUND

Typically, infants require fifteen or more hours of sleep each day in order to maintain proper health and development. Yet, as most parents know, it can be extremely difficult to soothe and relax an infant to get him or her to fall asleep. Parents may often have to get up multiple times a night and engage in strenuous activities to calm their child, such as pacing around their homes, rubbing and patting the back of the infant, or simply singing lullabies to relax the infant. These actives take a large physical toll on a parent or caregiver, and as this process repeats itself over time or occurs later and later at night, the parent may not have the energy or mental fortitude to effectively calm the baby back to sleep. This could lead to undesirable situations for both the parent and child as a chronic lack of sleep may lead to multiple problems, such as decreased cognitive performance, lack of social skills, obesity and decrease overall quality of life. Moreover, failure to effectively soothe a child may lead to excessive crying, which is associated with other undesirable developmental consequences which may show up later in life, such as a higher risk for hyperactivity, attention disorders, conduct problems, peer relationship problems, etc.

Therefore, there exists a long-felt need in the art for a device that can effectively and easily soothe a fussy and uncooperative child. Moreover, there exists a long-felt need in the art for an infant soothing device that features the ability to warm a child. There also exists a long-felt need in the art for an infant soothing device that can mimic different rhythmical motions to reduce certain strenuous activities associated with calming a child. Finally, there exists a long-felt need in the art for an infant soothing device that can be easily operated and lightweight, such that the user may utilize it while holding a heavy child.

The subject matter disclosed and claimed herein, in one embodiment thereof, comprises an infant soothing mitt device. The device is comprised of two identical surfaces that are fastened together in the shape of a hand, with a thumb area and a finger area. The device features a heating element that warms the entire device and a vibrating disc that produces soothing vibrations. A gel lining is fitted between the exterior and interior surface to amplify and reverberate the vibrations throughout the device. A control module is preferably fitted to the wrist area of the body and is used to control the differing functions of the device, such as a speaker, the heating element and the vibrating disc. The control module also features a battery, which powers the device and the speaker.

In this manner, the infant soothing mitt device of the present invention accomplishes all the forgoing objectives and provides a device that easily and effectively calms a child, without exerting a burdensome amount of energy. Further, the device is comprised of lightweight materials and gadgets which do not add significantly to the weight a user may already have to bear when holding a child. Lastly, the features and functions of the device are highly customizable, such that the user can effectively utilize the device in different scenarios which may require different strategies for child soothing.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an infant soothing mitt device. The device is primarily comprised of a mitt-shaped body that is further comprised of at least one vibrating disc, at least one heating element, a gel lining, and a control module with at least one button. The body of the device is preferably comprised of a silk-like fabric that copies and mimics the soft feel of skin, wherein the body follows the shape and contours of a hand, such that a user may wear the device as a glove. The wrist of the device is preferably comprised of two straps that may be removably-attached to each other through a system of hook and loop surfaces, which may be tightened or loosened to fit the circumference of a user's wrist.

The device features at least one heating element which warms the body of the device and at least one vibrating disc which pulsates throughout the device at various speeds and may be used to mimic a rhythmic patting motion. Within the body, a gel lining between the outer surface and inner surface of the device amplifies the vibrations and conducts the heat produced by the heating element. In addition, a speaker is fastened to the wrist of the device and can be programmed to emit various sounds, such as but not limited to: music, lullabies, spa or nature sounds, heartbeats, etc.

A control module is fastened to the wrist area and functions to control the different features of the device via a plurality of buttons, wherein the control module further has a battery. In differing embodiments of the device, the battery may be removably-attached to the device, such that the battery can be replaced if its efficiency is reduced, and/or the battery is damaged. The control module may also feature at least one USB port, such that the user can download different sounds or vibration patterns directly into the device for playback.

Accordingly, the infant soothing mitt device of the present invention is particularly advantageous as it provides the user the ability to soothe a child easily and efficiently. Because the device can mimic the strenuous activities associated with calming a child, a user does not have to physically exert him or herself as much as he or she would have to without the device. Moreover, the device features an easy-to-use control module that affords the user control over the device in a simplified way. Thus, the infant soothing mitt device overcomes the limitations of existing infant soothing mitt devices known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
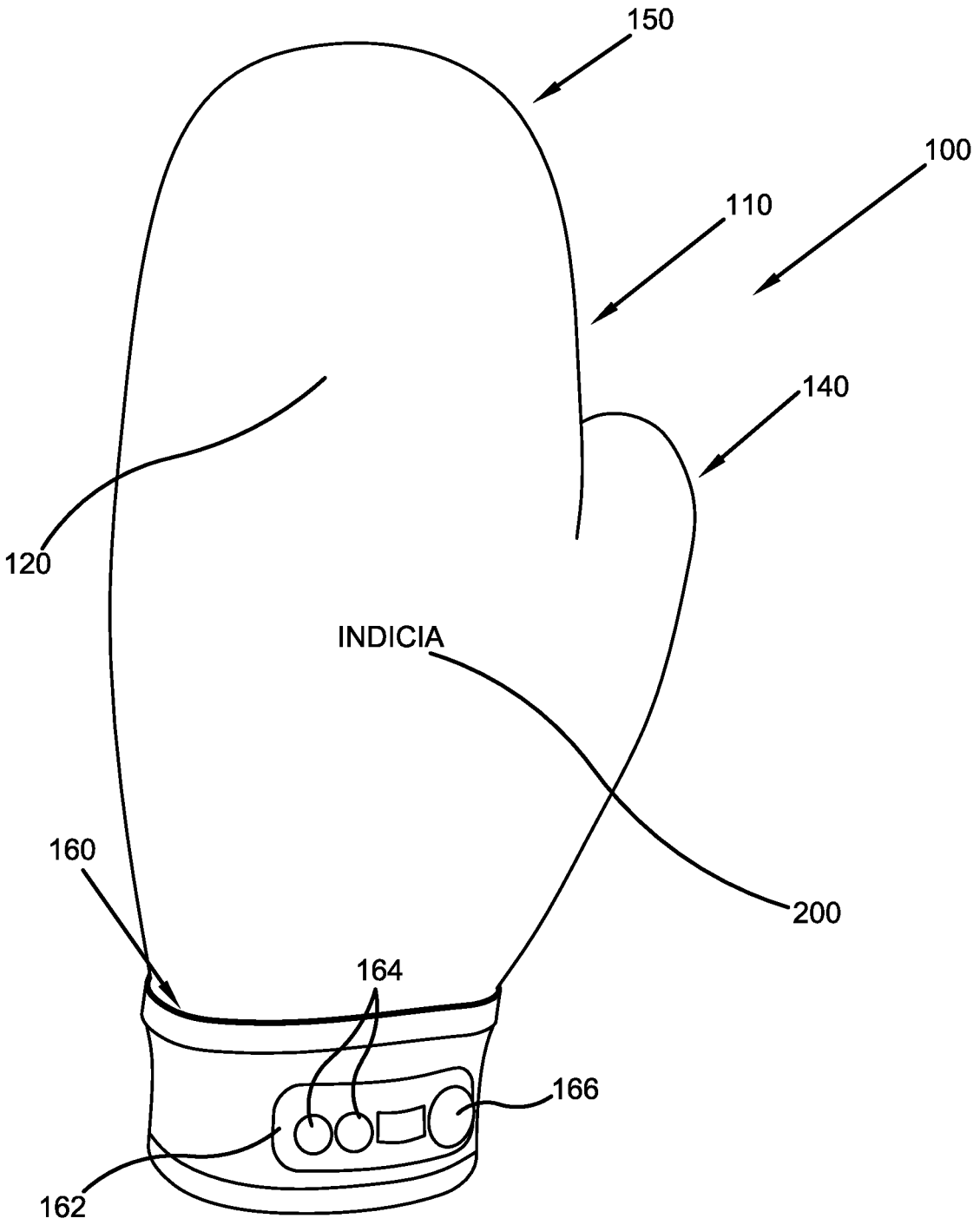
FIG. 1 illustrates a perspective view of one potential embodiment of the infant soothing mitt device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an infant soothing mitt device. There exists a long-felt need in the art for an infant soothing mitt device that simulates the rhythmic patting, pacing and swaying of a caregiver, without the need of physically engaging in those activities and motions. There also exists a long-felt need in the art for an infant soothing mitt device that can be heated to an optimum temperature, to keep the infant warm and to simulate the warmth of the caregiver. Moreover, there exists a long-felt need in the art for an infant soothing mitt device that can emit melodic sounds and music to comfort and relax an infant.

The present invention, in one exemplary embodiment, is comprised of an infant soothing mitt device. The body of the device is preferably comprised of a silk-like fabric that copies and mimics the soft feel of skin. The structure of the body follows the shape and contours of a hand, such that a user may wear the device as a glove. The wrist of the device is preferably comprised of two straps that may be removably-attached to each other through a system of hook and loop surfaces. The user may tighten or loosen these straps to fit the circumference of their wrist. The body of the device is preferably pink, blue, or neutral coloring. The body may also feature different indicia to enhance the appearance of the device.

The device features at least one heating element which warms the body of the device and at least one vibrating disc which pulsates throughout the device at various speeds and may be used to mimic a rhythmic patting motion. Within the body, a gel lining between the outer surface and inner surface of the device amplifies the vibrations and conducts the heat produced by the heating element. A speaker is fastened to the wrist of the device and can be programmed to emit different sounds such as, but not limited to, music, lullabies, spa or nature sounds, heartbeats, etc.

A control module is fastened to the wrist area and functions to control the different features of the device via a plurality of buttons. The control module features a battery that is used to power the device. In differing embodiments of the device, the battery may be removably-attached to the device, such that the battery can be replaced if its efficiency is reduced, and/or the battery is damaged. The control module may also feature at least one USB port, such that the user can download different sounds or vibration patterns directly into the device for playback.

Referring initially to the drawings, FIG. 1 illustrates a perspective view of one embodiment of the infant soothing mitt device 100 of the present invention. The device 100 is primarily comprised of a mitt-shaped body 110, shaped to receive a user's hand. The body 110 comprises an exterior surface 120 and an interior surface 130 (shown in FIG. 2), as well as a thumb area 140 and a finger area 150. A wrist area 160 of the body 110 features a continuous opening sized to receive a user's hand. The thumb area 140 and finger area 150 are sized to receive a user's hand and are shaped proportionately to the dimensions of a user's hand. The device 100 is preferably a one-size-fits-all model, but in differing embodiments, the device 100 may be comprised of other sizes such as, but not limited to, small, medium and large. The body 110 is preferably made of a soft silk-like fabric but may also be comprised of a multitude of different fabrics such as, but not limited to, vinyl, canvas, cashmere, chenille, chiffon, cotton, damask, jersey, lace, linen, wool, modal, polyester, satin, spandex, suede, tweed, twill, velvet, acrylic, modacrylic, nylon, polypropylene, polyurethane, polyvinyl chloride, polyethylene, vinylidene, benzoate, aramid, rayon, acetate, triacetate, etc., or any other suitable material as is known in the art.

To enhance the appearance of the device 100, the exterior surface 120 may be comprised of a plurality of decorative indicia 200, such as but not limited to patterns, logos, emblems, images, symbols, designs, letters, words, characters, animals, advertisements, brands, etc., or any other suitable indicia as is known in the art. The exterior surface 120 (or some other portion of the body 110) will preferably display the product name of the device 100 and may feature different words or phrases, such as but not limited to "God bless this baby". Different embodiments of the device 100 may be comprised of a multitude of colors, such as but not limited to neutral, pink and blue.

The wrist area 160 of the body 110 further comprises a control module 162 for controlling selective features of the device 100. The control module 162 comprises various buttons 164 and a speaker 166 and is described more fully below in FIG. 4.

Figure 2:
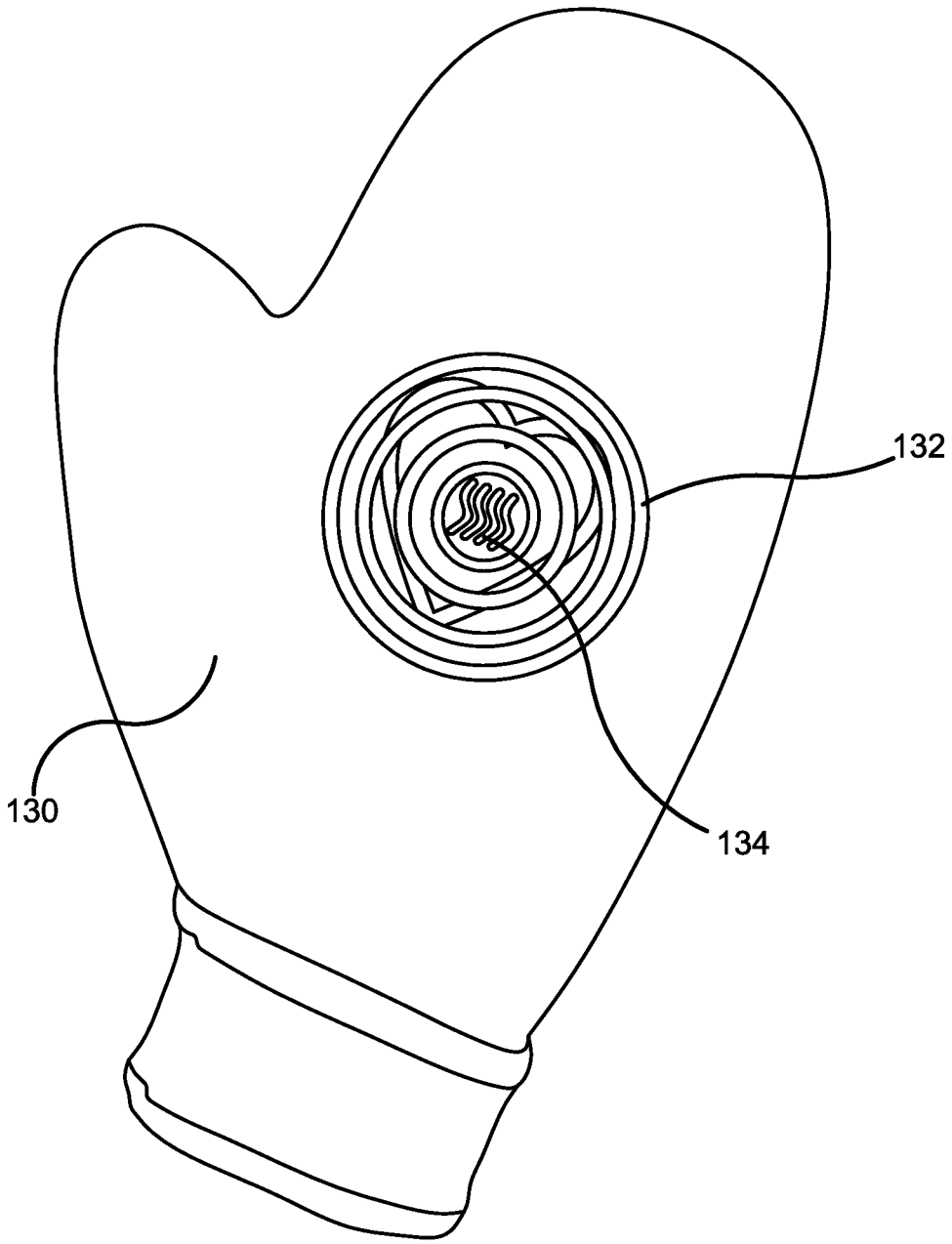
FIG. 2 illustrates a perspective view of one potential embodiment of the infant soothing mitt device of the present invention disclosing the heating element and vibrating disc in accordance with the disclosed architecture.

FIG. 2 illustrates a perspective view of one embodiment of the infant soothing mitt device 100 of the present invention further disclosing the heating element and vibrating disc. Specifically, the body 110 of the device comprises an interior surface 130 that is further comprised of at least one vibrating disc 132 and at least one heating element 134. The at least one heating element 134 is fitted between the interior surface 130 and the exterior surface 120, wherein the heating element 134 may or may not be exposed through a continuous opening in the interior surface 130. The heating element 134 is preferably an electric coil burner or similar heating element of the like, but may be fitted with other suitable heating mechanisms as is known in the art. Typically, the heating element 134 is powered by a battery or other suitable power source. Further, the at least one vibrating disc 132 is fitted between the interior surface 130 and the exterior surface 120 and produces soothing vibrations that can be transferred to an infant 12. In differing embodiments, the vibrating disc 132 may have a plurality of vibration intensities, rhythms, patterns, frequencies, etc., or any other suitable vibrations as is known in the art. Typically, the vibrating disc 132 is powered by a battery or other suitable power source.

Figure 3:
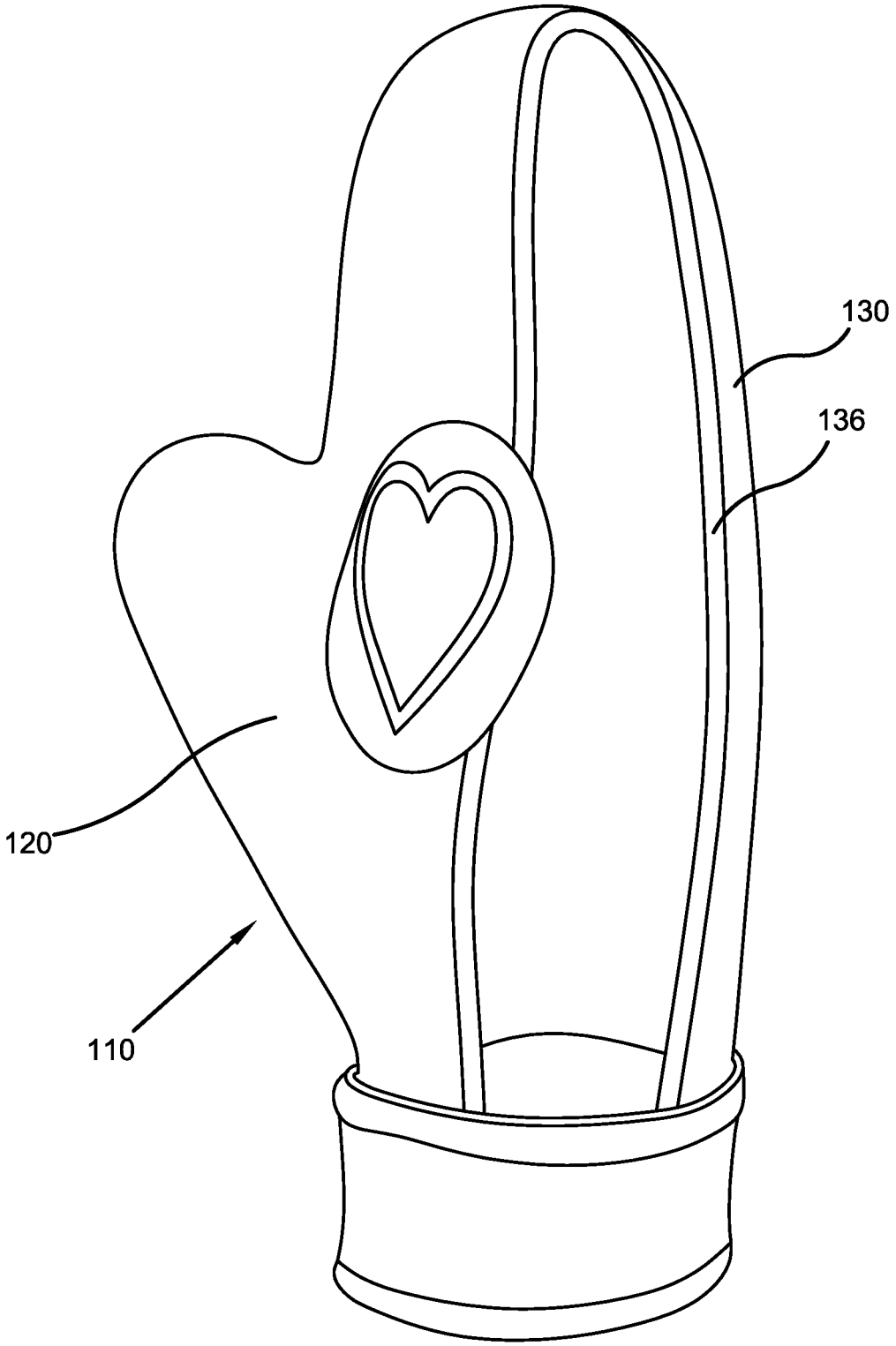
FIG. 3 illustrates a cross-sectional view of one potential embodiment of the infant soothing mitt device of the present invention in accordance with the disclosed architecture.

FIG. 3 illustrates a cross-sectional view of one embodiment of the infant soothing mitt device 100 of the present invention. As shown in the cross-sectional diagram, the interior of the device 100 body 110 comprises a gel lining 136. The gel lining 136 is typically fitted between the exterior surface 120 and the interior surface 130. The gel lining 136 acts to amplify the vibrations produced by the vibrating disc 132 and to conduct the heat produced by the heating element 134. The gel lining 136 can comprise any suitable gel as is known in the art to amplify vibrations and conduct heat.

Figure 4:
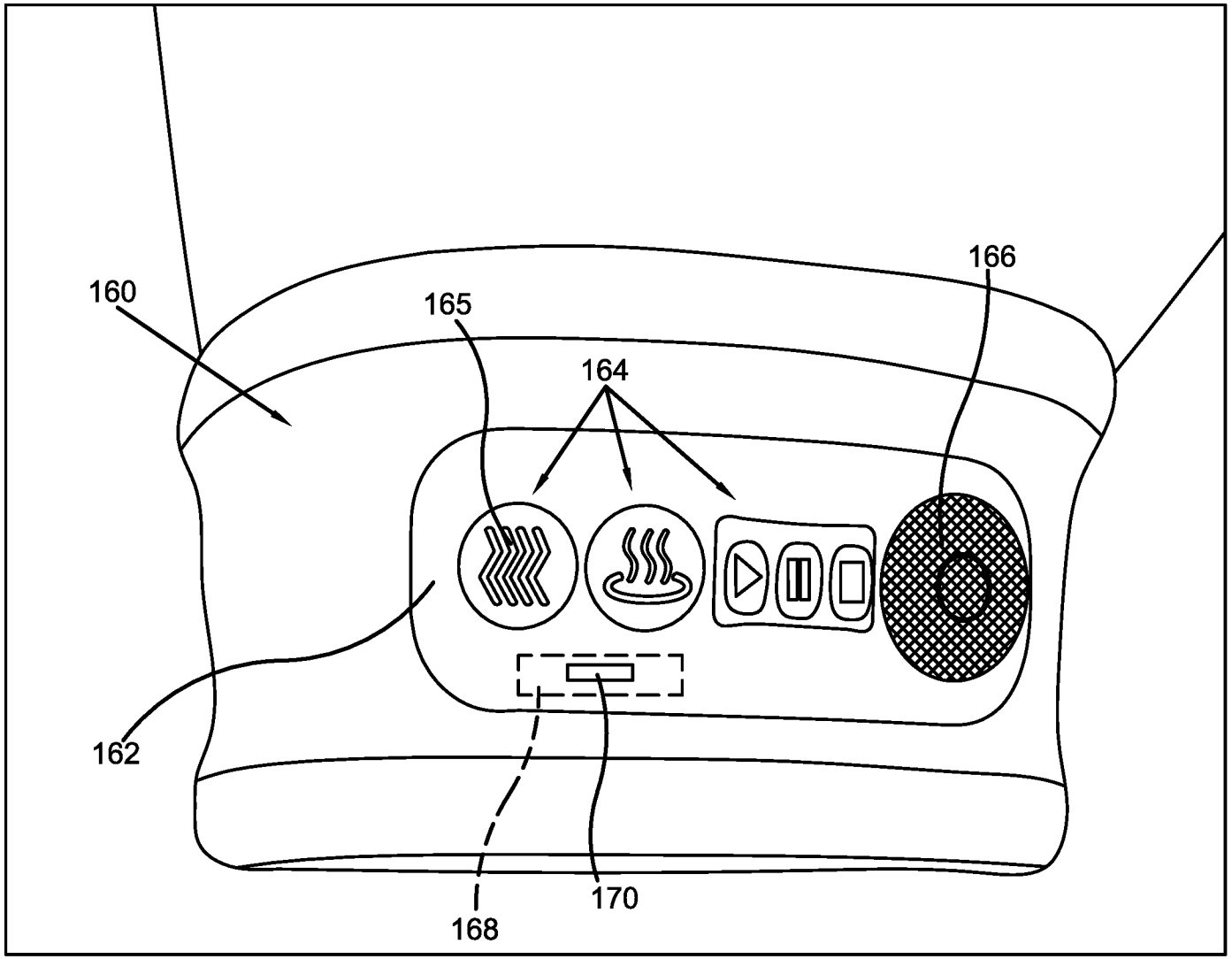
FIG. 4 illustrates an enhanced perspective view of the control module of one potential embodiment of the infant soothing mitt device of the present invention in accordance with the disclosed architecture.

FIG. 4 illustrates an enhanced perspective view of the wrist area 160 of the infant soothing mitt device 100 of the present invention. The wrist area 160 comprises a control module 162 with at least one button 164 and at least one speaker 166. The control module 162 is fastened to the wrist area 160 of the body 110 of the device 100. The control module 162 features a series of buttons 164 which correspond to different functions of the device 160, such as the heating element 134, the vibrating disc 132 and a speaker 166. The control module 162 allows a user to control the device 100 features via pressing the buttons 164. The control module 162 can comprise any suitable number of buttons 164 as is known in the art, depending on the features of the device 100 a user wishes to control.

Further, specific indicia 165 on the buttons 164 identify which function the button 164 controls. For example, to control the speaker 166 function of the device 100, indicia 165 in the form of a sideways triangle may denote the 'play music' function which causes the speaker 166 to begin playing, indicia 165 in the form of two parallel lines may denote the 'pause music' function which causes the speaker 166 to pause any sound that is playing, and indicia 165 in the form of a square may represent the 'stop music' function which causes the speaker 166 to stop playing any sounds. Any suitable indicia 165 as is known in the art can be included on the buttons 164.

Additionally, the control module 162 comprises a USB port 170, such that the user 10 may download, transfer and store a plurality of different sounds that can be played by the speaker 166 such as, but not limited to, music, white noise, voice recordings, sounds, etc., or any other suitable sounds as are known in the art. The device 100 may also feature the capability of downloading different vibration patterns that sync to the specific beats and sounds being played from the speaker 166.

Further, to power the different functions of the device 100, the control module 162 comprises a battery 168. The battery 168 may be a disposable battery or a rechargeable battery in the form of an alkaline, nickel-cadmium, nickel-metal hydride battery, etc., such as any 3V-12 volts DC battery or other conventional battery, such as A, AA, AAA, etc., that supply power to the device 100. Throughout this specification the term "battery" may be used interchangeably to refer to one or more wet or dry cells or batteries of cells in which chemical energy is converted into electricity and used as a source of DC power. References to recharging or replacing the battery 168 may refer to recharging or replacing individual cells, individual batteries of cells, or a package of multiple battery cells as is appropriate for any given battery technology that may be used. In addition, a rechargeable embodiment of the battery 168 may be recharged using the USB port 170, wherein the USB port 170 is a USB-A, USB-B, Micro-B, Micro-USB, Mini-USB, or USB-C port, etc.

Figure 5:
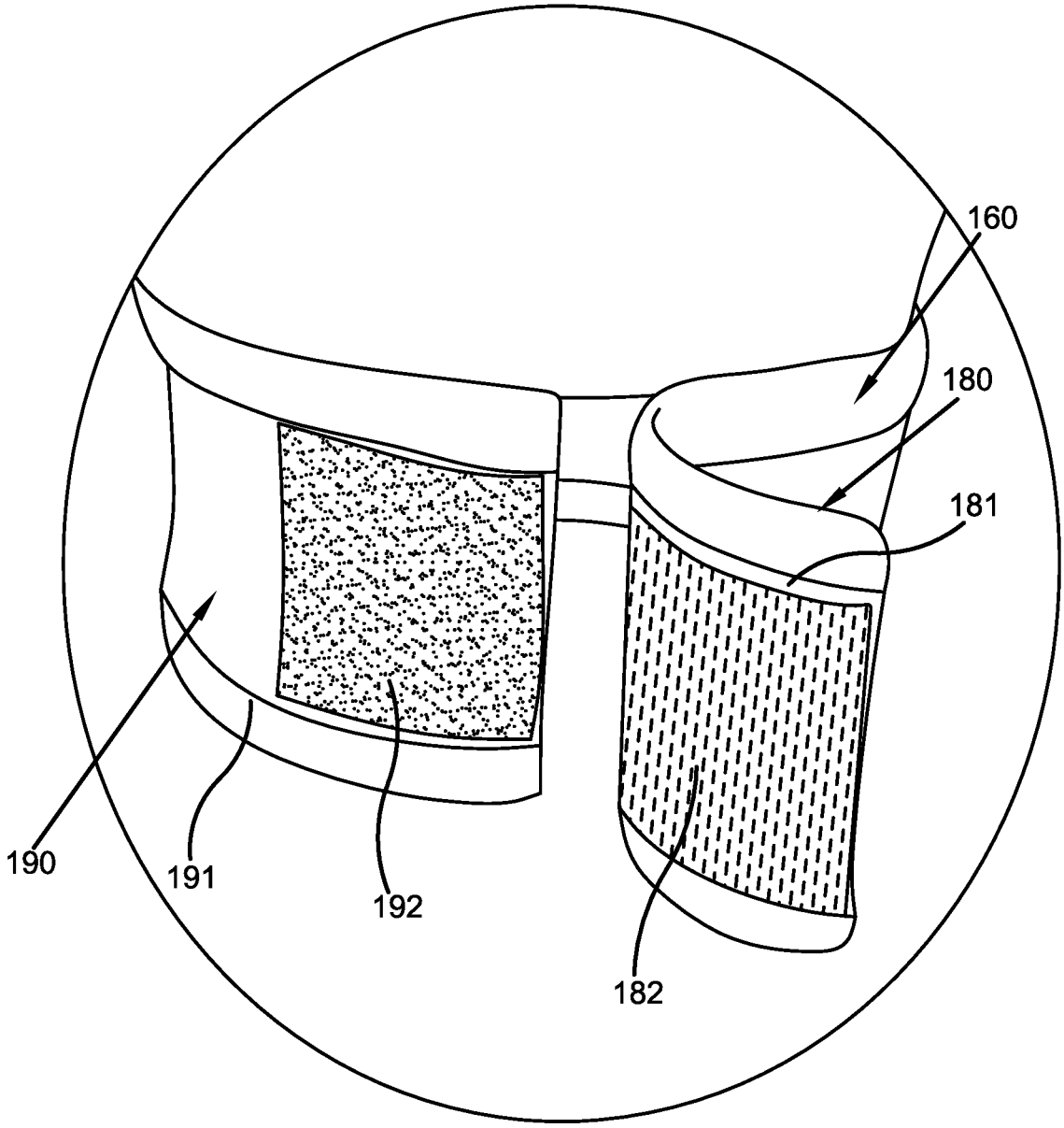
FIG. 5 illustrates an enhanced perspective view of the wrist fastener of one potential embodiment of the infant soothing mitt device of the present invention in accordance with the disclosed architecture.

FIG. 5 illustrates an enhanced perspective view of one embodiment of the wrist area 160 of the infant soothing mitt device 100 of the present invention. The wrist area 160 comprises a first wrist strap 180 and a second wrist strap 190. Each wrist strap 180, 190 has at least one fastener 182, 192 to secure the first and second wrist straps 180, 190 together. The wrist area 160 of the device 100 preferably utilizes a hook and loop system to attach the fastener 182 of the first wrist strap 180 to the fastener 192 of the second wrist strap 190, however any suitable fastener as is known in the art can be used to fasten the wrist straps 180, 190 together.

Accordingly, the device 100 can be adjusted to differing sizes to secure a user's 10 hand within the body 110 of the device 100 appropriately. Typically, for the first wrist strap 180, the fastener 182 is positioned on the bottom surface 181 of the first wrist strap 180. For the second wrist strap 190, the fastener 192 is positioned on the top surface 191 of the second wrist strap 190, however the fasteners 182 and 192 can be positioned at any suitable position on the first and second wrist straps 180 and 190 as is known in the art. Different embodiments of the device 100 may feature other suitable fastening mechanisms as are known in the art such as, but not limited to, magnetic, snap-button, ties, button and button-hold, zipper, etc.

Figure 6:
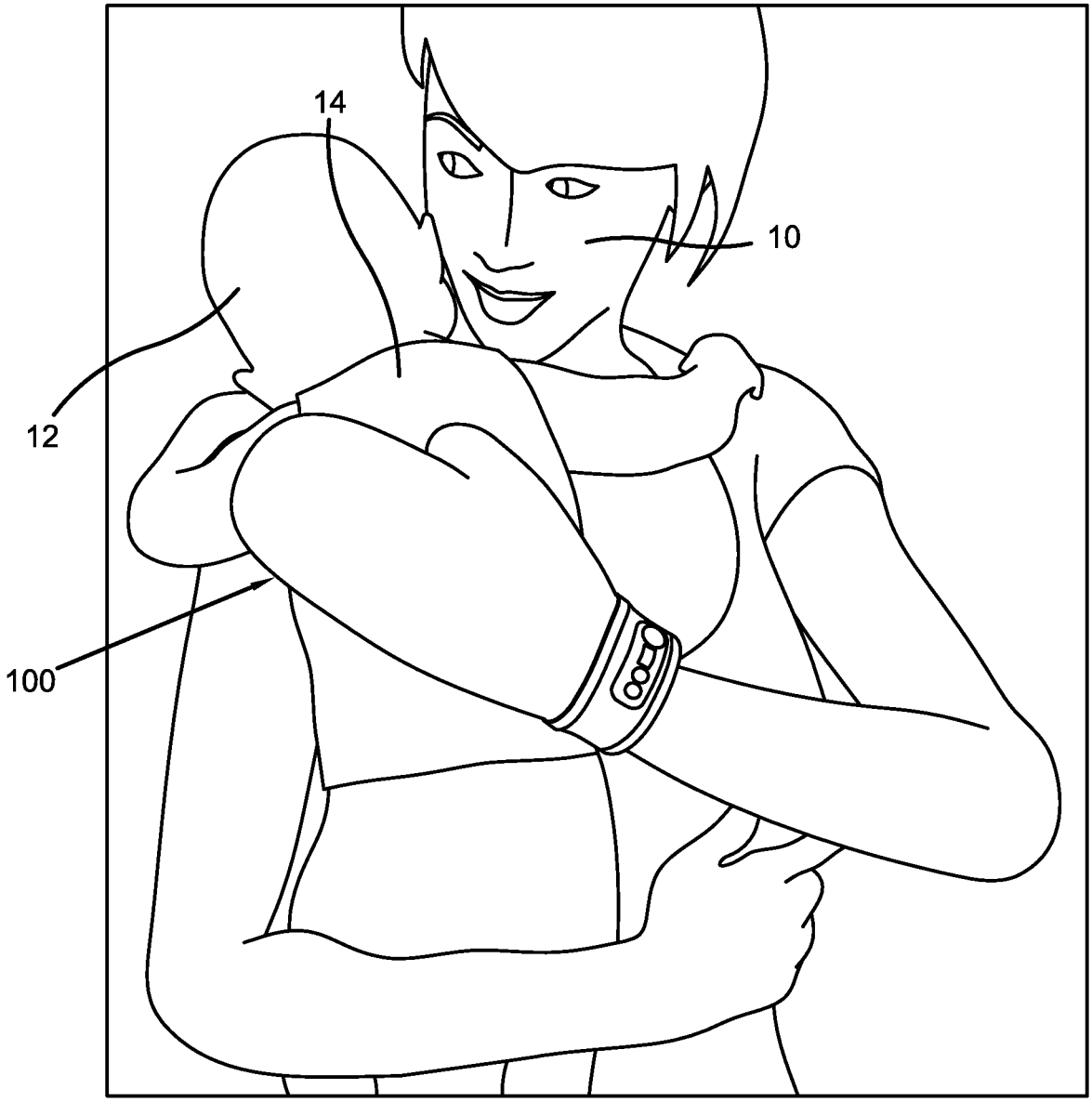
FIG. 6 illustrates a perspective view of one potential embodiment of the infant soothing mitt device of the present invention while being worn by a user and being used to soothe an infant in accordance with the disclosed architecture.

FIG. 6 illustrates a perspective view of one embodiment of the infant soothing mitt device 100 of the present invention while being worn by a user 10 and being used to soothe an infant 12. The user 10 preferably engages the heating element 134, vibrating disc 132 and/or speaker 166, and places his or her hand containing the device 100 on the infant's back 14. The heating element 134, vibrating disc 132 and/or speaker 166 may then be used simultaneously or in any combination to eliminate the need for the user 10 to physically exert themselves, while soothing the infant 12 in the same or similar manner.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "infant soothing mitt device" and "device" are interchangeable and refer to the infant soothing mitt device 100 of the present invention.

Notwithstanding the forgoing, the infant soothing mitt device 100 of the present invention and its various components can be of any suitable size and configuration as is known in the art without affecting the overall concept of the invention, provided that they accomplish the above-stated objectives. One of ordinary skill in the art will appreciate that the size, configuration and material of the infant soothing mitt device 100 as shown in FIGS. 1-6 is for illustrative purposes only, and that many other sizes and shapes of the infant soothing mitt device 100 are well within the scope of the present disclosure. Although the dimensions of the infant soothing mitt device 100 are important design parameters for user convenience, the infant soothing mitt device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An infant soothing mitt device comprising:

a body comprised of an exterior surface, an interior surface, and a gel lining positioned in between the exterior surface and the interior surface;

at least one heating element located between the exterior surface and the interior surface;

at least one vibrating disc located between the exterior surface and the interior surface;

at least one control module having a plurality of buttons and at least one speaker; and a battery that powers the at least one heating element, the at least one vibrating disk, and the at least one speaker.

2. The infant soothing mitt device of claim 1, wherein the gel lining amplifies a vibration produced by the at least one vibrating disc.

3. The infant soothing mitt device of claim 1, wherein the at least one control module is positioned on a wrist area of the infant soothing mitt device.

4. The infant soothing mitt device of claim 1, wherein the at least one vibrating disc comprises a plurality of vibration intensities, a plurality of rhythms, a plurality of patterns and a plurality of frequencies.

5. The infant soothing mitt device of claim 1, wherein the at least one heating element is an electric coil burner.

6. The infant soothing mitt device of claim 1, wherein the at least one speaker emits a plurality of sounds, music, white noise, and voice recordings.

7. An infant soothing mitt device comprising:

a body comprised of an exterior surface, an interior surface and a gel lining positioned in between the exterior surface and the interior surface;

at least one heating element located between the exterior surface and the interior surface;

at least one vibrating disc located between the exterior surface and the interior surface;

at least one control module with a plurality of buttons and at least one speaker;

a wrist area with a first wrist strap and a second wrist strap, wherein the first wrist strap and the second wrist strap are secured to one another; and a battery that powers the at least one heating element, the at least one vibrating disk, and the at least one speaker, wherein the infant soothing mitt device is sized and configured to be worn on a hand of a user to soothe an infant by placing the hand of the user on a back of the infant.

8. The infant soothing mitt device of claim 7, wherein the plurality of buttons allow the user to control the at least one heating element, the at least one speaker and the at least one vibrating disc.

9. The infant soothing mitt device of claim 7 further comprising a USB port for recharging the battery.

10. The infant soothing mitt device of claim 7, wherein the at least one vibrating disc comprises a plurality of vibration intensities, a plurality of rhythms, a plurality of patterns and a plurality of frequencies.

11. The infant soothing mitt device of claim 7, wherein the at least one heating element is an electric coil burner.

12. The infant soothing mitt device of claim 7, wherein the at least one speaker can play a plurality of sounds, music, white noise and voice recordings.

13. The infant soothing mitt device of claim 9, wherein the USB port allows the user to transfer the plurality of sounds to the speaker.

14. The infant soothing mitt device of claim 7, wherein the first wrist strap and the second wrist strap attach to one another via at least one fastener.

15. The infant soothing mitt device of claim 14, wherein the at least one fastener is a hook and loop fastener.

* * * * *